US009691229B2

(12) United States Patent
Karra

(10) Patent No.: US 9,691,229 B2
(45) Date of Patent: Jun. 27, 2017

(54) GAME-OPERATING COMPUTER SYSTEMS FOR GAMES HAVING COMMUNITY PRIZE(S) AND COMPUTER-IMPLEMENTED METHODS OF USE THEREOF

(71) Applicant: Intralot S.A.—Integrated Lottery Systems and Services, Athens (GR)

(72) Inventor: Gianna Karra, Athens (GR)

(73) Assignee: Intralot S.A.—Integrated Lottery Systems and Services, Athens (GR)

( * ) Notice: Subject to any disclaimer, the term of this patent is extended or adjusted under 35 U.S.C. 154(b) by 190 days.

(21) Appl. No.: 14/584,947

(22) Filed: Dec. 29, 2014

(65) Prior Publication Data

US 2015/0187164 A1 Jul. 2, 2015

Related U.S. Application Data

(60) Provisional application No. 61/921,276, filed on Dec. 27, 2013.

(51) Int. Cl.
*G07F 17/32* (2006.01)

(52) U.S. Cl.
CPC ..... *G07F 17/329* (2013.01); *G07F 17/3225* (2013.01)

(58) Field of Classification Search
USPC ..... 463/16, 17
See application file for complete search history.

(56) References Cited

U.S. PATENT DOCUMENTS

| | | | | |
|---|---|---|---|---|
| 9,251,663 | B1 * | 2/2016 | Sandvick | G07F 17/329 |
| 9,443,397 | B1 * | 9/2016 | Sandvick | G07F 17/329 |
| 2007/0167216 | A1 * | 7/2007 | Walker | A63F 9/00 463/18 |
| 2010/0022290 | A1 | 1/2010 | Oakes et al. | |
| 2011/0207515 | A1 | 8/2011 | Covington | |

(Continued)

FOREIGN PATENT DOCUMENTS

WO 2010/048540 A1 4/2010

OTHER PUBLICATIONS

International Search Report and Written Opinion from international Application No. PCT/IB2014/003189 dated Jul. 3, 2015.

*Primary Examiner* — Pierre E Elisca
(74) *Attorney, Agent, or Firm* — Greenberg Traurig, LLP

(57) ABSTRACT

In some embodiments, the present invention provides for a game-operating computer game system, that includes at least one server and software stored on a non-transient computer readable medium accessible by the at least one server, where the software is at least configured to: (a) conduct the game drawing; (b) determine at least one winning ticket based on the game drawing; (c) identify at least one winning purchase location of the at least one winning ticket; (d) identify at least one pool of non-winning players based on the at least one winning purchase location; (e) calculate a community prize; (f) divide the community prize to determine a plurality of non-winning prizes; (g) award the plurality of non-winning prizes to the at least one pool of non-winning players; and (h) display a notification about each of the plurality of non-winning prizes to each non-winning player of the pool of non-winning players.

20 Claims, 8 Drawing Sheets

(56) References Cited

U.S. PATENT DOCUMENTS

| | | | | |
|---|---|---|---|---|
| 2012/0264499 | A1* | 10/2012 | Walker | G07F 17/329 463/19 |
| 2013/0310130 | A1 | 11/2013 | Asthana | |
| 2015/0279156 | A1* | 10/2015 | Omar | G06Q 30/06 463/22 |
| 2016/0042601 | A1* | 2/2016 | Walker | A63F 9/00 463/16 |

* cited by examiner

*Example of map showing lottery points of sale and winners based on top winning ticket point of purchase*

| Categories | The player matches<br>*Main numbers (59 numbers) + Powerball (1/35)* | Distributed | Percentage of sales | Winners | Prize per winner | Odds (1 out of ...) |
|---|---|---|---|---|---|---|
| I | 5 main numbers + Powerball | $112,057,390 | 31.98% | 1 | *jackpot starting at $40 mil (exp $112,057,390)* | 175,223,510.00 |
| II | 5 main numbers only | $34,000,000 | 9.70% | 34 | $1,000,000 | 5,153,632.65 |
| III | 4 main numbers + Powerball | $2,700,000 | 0.77% | 270 | $10,000 | 648,975.96 |
| IV | 4 main numbers only | $918,000 | 0.26% | 9,180 | $100 | 19,087.53 |
| V | 3 main numbers + Powerball | $1,431,000 | 0.41% | 14,310 | $100 | 12,244.83 |
| VI | 3 main numbers only | $3,405,780 | 0.97% | 486,540 | $7 | 360.14 |
| VII | 2 main numbers + Powerball | $1,736,280 | 0.50% | 248,040 | $7 | 706.43 |
| VIII | 1 main number + Powerball | $6,325,020 | 1.80% | 1,581,255 | $4 | 110.81 |
| IX | Only Powerball | $12,650,040 | 3.61% | 3,162,510 | $4 | 55.41 |
| **TOTAL POWERBALL** | | **175,223,510** | **50.00%** | | | **1 out of 31.85** |

| | | | | | |
|---|---|---|---|---|---|
| **Community prize** | $20,290,882 | 5.79% | 406,081 | *$50.0* | 440 |

FIG. 5

| Categories | The player matches<br>*Main numbers (59 numbers) + Powerball (1/35)* | Distributed | Percentage of sales | Winners | Prize per winner | Odds (1 out of ...) |
|---|---|---|---|---|---|---|
| I | 5 main numbers + Powerball | $112,057,390 | 31.98% | 1 | *jackpot starting at $40 mil (exp $112,057,390)* | 175,223,510.00 |
| II | 5 main numbers only | $25,500,000 | 7.28% | 34 | $750,000 | 5,153,632.65 |
| III | 4 main numbers + Powerball | $2,025,000 | 0.58% | 270 | $7,500 | 648,975.96 |
| IV | 4 main numbers only | $688,500 | 0.20% | 9,180 | $75 | 19,087.53 |
| V | 3 main numbers + Powerball | $1,073,250 | 0.31% | 14,310 | $75 | 12,244.83 |
| VI | 3 main numbers only | $1,946,160 | 0.56% | 486,540 | $4 | 360.14 |
| VII | 2 main numbers + Powerball | $992,160 | 0.28% | 248,040 | $4 | 706.43 |
| VIII | 1 main number + Powerball | $3,162,510 | 0.90% | 1,581,255 | $2 | 110.81 |
| IX | Only Powerball | $6,325,020 | 1.80% | 3,162,510 | $2 | 55.41 |
| **TOTAL POWERBALL** | | **153,769,990** | **43.88%** | | | **1 out of 31.85** |
| **Community prize** | | $21,453,520 | 6.12% | 406,081 | *$52.8* | 440 |

FIG. 6

GAME-OPERATING COMPUTER SYSTEMS FOR GAMES HAVING COMMUNITY PRIZE(S) AND COMPUTER-IMPLEMENTED METHODS OF USE THEREOF

RELATED APPLICATIONS

This application claims the priority of U.S. provisional application U.S. Patent Appln. No. 61/921,276; filed Dec. 27, 2013; entitled "COMPUTER-IMPLEMENTED METHODS AND COMPUTER SYSTEMS RELATED TO CONDUCTING AND PLAYING GAMES HAVING COMMUNITY PRIZE(S) SUCH AS LOTTERY GAMES," which is incorporated herein by reference in its entirety for all purposes.

TECHNICAL FIELD

In some embodiments, the present instant invention is related to game-operating computer systems related to for conducting and playing games having community prize(s) and computer-implemented methods of use thereof.

BACKGROUND

A player's probability to win a lottery decreases every time the lottery generates greater prices, as the odds against winning are increased. Typically, the odds against winning are approximately 14,000,000 to 1 and can increase to about 175,000,000 to 1 (e.g., Mega Millions Jackpot).

SUMMARY OF INVENTION

In some embodiments, the present invention provides for a game-operating computer system, including: at least one server and software stored on a non-transient computer readable medium accessible by the at least one server, where the software is at least configured to: (a) conduct the game drawing; (b) determine at least one winning ticket based on the game drawing; (c) identify at least one winning purchase location of the at least one winning ticket of the game drawing; (d) identify at least one pool of non-winning players based on the at least one winning purchase location of the at least one winning ticket of the game drawing; (i) where the at least one pool of non-winning players is determined by at least one identifier, (ii) where the at least one identifier is based on at least one geographic identifier associated with at least one of: 1) a residence of a non-winning player, 2) a location of a non-winning player, 3) a purchase location utilized by a non-winning player to purchase a non-winning ticket, and 4) any combination thereof, (iii) where the at least one geographic identifier is selected from a group consisting of: a postcode identifier, a district identifier, a suburb identifier, a mapped location identifier, a telephone code identifier, geographic coordinate identifier, pre-determined geographic identifier set by a game conducting authority, and any combination thereof, and (e) calculate a community prize based on: 1) the at least one pool of non-winning players, 2) draw sales, and 3) a prize amount allocated to the at least one winning ticket; (f) divide the community prize based on a number of non-winning tickets in the at least one pool of non-winning players to determine a plurality of non-winning prizes; (g) award the plurality of non-winning prizes to the at least one pool of non-winning players; and (h) cause to display, via a specifically programmed graphical user interface, a notification about each of the plurality of non-winning prizes to each non-winning player of the pool of non-winning players.

In some embodiments, the game drawing is a lottery. In some embodiments, the non-winning player chooses between 1 and 5 of 6 winning numbers. In some embodiments, the non-winning player chooses between 1 and 4 of 5 winning numbers. In some embodiments, the pool of non-winning players is at least a thousand non-winning players. In some embodiments, the draw sales are at least partially funded from at least one previous game drawing.

In some embodiments, the instant invention provides for a game-operating computer system, including: at least one server and software stored on a non-transient computer readable medium accessible by the at least one server, where the software is at least configured to: (a) conduct the game drawing; (b) determine at least one winning ticket based on the game drawing; (c) identify at least one winning purchase location of the at least one winning ticket of the game drawing; (d) identify at least one pool of non-winning players based on the at least one winning purchase location of the at least one winning ticket of the game drawing; (i) where the at least one pool of non-winning players is determined by at least one identifier, (ii) where the at least one identifier is based on at least one geographic identifier associated with at least one of: 1) a residence of a non-winning player, 2) a location of a non-winning player, 3) a purchase location utilized by a non-winning player to purchase a non-winning ticket, and 4) any combination thereof, (iii) where the at least one geographic identifier is selected from a group consisting of: a postcode identifier, a district identifier, a suburb identifier, a mapped location identifier, a telephone code identifier, geographic coordinate identifier, pre-determined geographic identifier set by a game conducting authority, and any combination thereof, and (e) calculate a community prize based on: 1) the at least one pool of non-winning players, 2) draw sales, and 3) a prize amount allocated to the at least one winning ticket; (f) divide the community prize based on a predetermined number to generate a plurality of non-winning prizes; (g) award the plurality of non-winning prizes to the at least one pool of non-winning players; and (h) cause to display, via a specifically programmed graphical user interface, a notification about each of the plurality of non-winning prizes to each non-winning player of the pool of non-winning players.

In some embodiments, the game drawing is a lottery. In some embodiments, the non-winning player chooses between 1 and 5 of 6 winning numbers. In some embodiments, the non-winning player chooses between 1 and 4 of 5 winning numbers. In some embodiments, the pool of non-winning players is at least a thousand non-winning players. In some embodiments, the draw sales are at least partially funded from at least one previous game drawing.

In some embodiments, the instant invention provides for a game-operating computer method, including: (a) conducting, by at least one server, the game drawing; (b) determining, by the at least one server, at least one winning ticket based on the game drawing; (c) identifying, by the at least one server, at least one winning purchase location of the at least one winning ticket of the game drawing; (d) identifying, by the at least one server, at least one pool of non-winning players based on the at least one winning purchase location of the at least one winning ticket of the game drawing; (i) where the at least one pool of non-winning players is determined by at least one identifier, (ii) where the at least one identifier is based on at least one geographic identifier associated with at least one of: 1) a residence of a non-winning player, 2) a location of a non-winning player, 3) a purchase location utilized by a non-winning player to purchase a non-winning ticket, and 4) any combination thereof, (iii) where the at least one geographic identifier is selected from a group consisting of: a postcode identifier, a district identifier, a suburb identifier, a mapped location identifier, a telephone code identifier, geographic coordinate identifier, pre-determined geographic identifier set by a game conducting authority, and any combination thereof, and (e) calculating, by the at least one server, a community prize based on: 1) the at least one pool of non-winning players, 2) draw sales, and 3) a prize amount allocated to the at least one winning ticket; (f) dividing, by the at least one server, the community prize based on a number of non-winning tickets in the at least one pool of non-winning players to determine a plurality of non-winning prizes; (g) awarding, by the at least one server, the plurality of non-winning prizes to the at least one pool of non-winning players; and (h) causing to display, by the at least one server, via a specifically programmed graphical user interface, a notification about each of the plurality of non-winning prizes to each non-winning player of the pool of non-winning players.

In some embodiments, the game drawing is a lottery. In some embodiments, the non-winning player chooses between 1 and 5 of 6 winning numbers. In some embodiments, the non-winning player chooses between 1 and 4 of 5 winning numbers. In some embodiments, the pool of non-winning players is at least a thousand non-winning players. In some embodiments, the draw sales are at least partially funded from at least one previous game drawing.

In some embodiments, the instant invention provides for a game-operating computer method, including: (a) conducting, by at least one server, the game drawing; (b) determining, by the at least one server, at least one winning ticket based on the game drawing; (c) identifying, by the at least one server, at least one winning purchase location of the at least one winning ticket of the game drawing; (d) identifying, by the at least one server, at least one pool of non-winning players based on the at least one winning purchase location of the at least one winning ticket of the game drawing; (i) where the at least one pool of non-winning players is determined by at least one identifier, (ii) where the at least one identifier is based on at least one geographic identifier associated with at least one of: 1) a residence of a non-winning player, 2) a location of a non-winning player, 3) a purchase location utilized by a non-winning player to purchase a non-winning ticket, and 4) any combination thereof, (iii) where the at least one geographic identifier is selected from a group consisting of: a postcode identifier, a district identifier, a suburb identifier, a mapped location identifier, a telephone code identifier, geographic coordinate identifier, pre-determined geographic identifier set by a game conducting authority, and any combination thereof, and (e) calculating, by the at least one server, a community prize based on: 1) the at least one pool of non-winning players, 2) draw sales, and 3) a prize amount allocated to the at least one winning ticket; (f) dividing, by the at least one server, the community prize based on a predetermined number to generate a plurality of non-winning prizes; (g) awarding, by the at least one server, the plurality of non-winning prizes to the at least one pool of non-winning players; and (h) causing to display, by the at least one server, via a specifically programmed graphical user interface, a notification about each of the plurality of non-winning prizes to each non-winning player of the pool of non-winning players.

In some embodiments, the game drawing is a lottery. In some embodiments, the non-winning player chooses between 1 and 5 of 6 winning numbers. In some embodiments, the non-winning player chooses between 1 and 4 of 5 winning numbers. In some embodiments, the pool of non-winning players is at least a thousand non-winning players. In some embodiments, the draw sales are at least partially funded from at least one previous game drawing.

BRIEF DESCRIPTION OF THE DRAWINGS

FIGS. 1-8 illustrate certain aspects of the present invention in accordance with some embodiments of the present invention.

Figure 1:
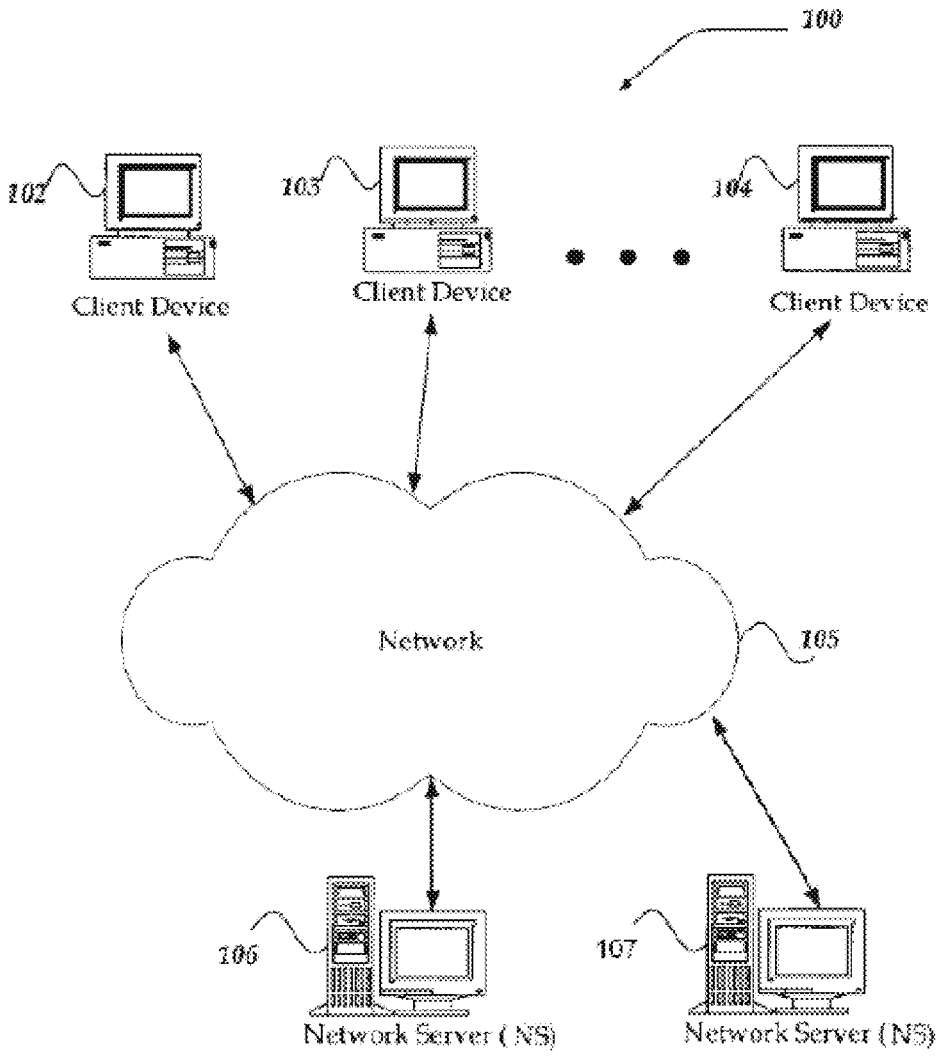

The figures constitute a part of this specification and include illustrative embodiments of the present invention and illustrate various objects and features thereof. Further, the figures are not necessarily to scale, some features may be exaggerated to show details of particular components. In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the present invention.

DESCRIPTION OF EXEMPLARY EMBODIMENTS

Among those benefits and improvements that have been disclosed, other objects and advantages of this invention will become apparent from the following description taken in conjunction with the accompanying figures. Detailed embodiments of the present invention are disclosed herein; however, it is to be understood that the disclosed embodiments are merely illustrative of the invention that may be embodied in various forms. In addition, each of the examples given in connection with the various embodiments of the invention which are intended to be illustrative, and not restrictive.

Throughout the description, the following terms take the meanings explicitly associated herein, unless the context clearly dictates otherwise. The phrases "in one embodiment" and "in some embodiments" as used herein do not necessarily refer to the same embodiment(s), though it may. Furthermore, the phrases "in another embodiment" and "in some other embodiments" as used herein do not necessarily refer to a different embodiment, although it may. Thus, as described below, various embodiments of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

It is understood that at least one aspect/functionality of various embodiments described herein can be performed in real-time and/or dynamically. As used herein, the term "real-time" is directed to an event/action can occur instantaneously or almost instantaneously in time when another event/action has occurred. In some embodiments, the terms "instantaneous," "instantaneously," "instantly," and "in real time" refer to a condition where a time difference between a first time when a search request is transmitted and a second time when a response to the request is received is no more than 1 second. In some embodiments, the time difference between the request and the response is between less than 1 second and several seconds.

As used herein, the term "dynamic(ly)" means that events and/or actions can be triggered and/or occur without any human intervention. In some embodiments, events and/or actions in accordance with the present invention can be in real-time and/or based on a predetermined periodicity of at least one of: nanosecond, several nanoseconds, millisecond, several milliseconds, second, several seconds, minute, several minutes, hourly, several hours, daily, several days, weekly, monthly, etc.

In some embodiments, the inventive game system(s) can include the use of electronic mobile devices (e.g., smartphones, etc.) of players and server(s) in the distributed network environment, communicating over a suitable data communication network (e.g., the Internet, etc.) and utilizing at least one suitable data communication protocol (e.g., IPX/SPX, X.25, AX.25, AppleTalk, TCP/IP (e.g., HTTP), etc.).

In some embodiments, each inventive game system(s) can include the use of a electronic terminal(s), where the electronic terminal(s) can be any purpose terminal that transacts with individuals (e.g., a lottery terminal, a gaming terminal, a vending machine, an individual's mobile device being programmed to serve, as, for example, lottery and/or gaming terminal, etc.).

While examples provided in the description are primarily directed to playing and conducting lottery games, those examples are not restrictive and other types of wager and/or non-wager games can be played and/or conducted in accordance with the principles of the exemplary embodiments of the present invention that are disclosed herein.

In some embodiments, the exemplary inventive game system(s) of the present invention are configured to result in preserving winner anonymity by awarding at least one additional prize divided among non-winning tickets/participants/combinations of the same drawing that were purchased/distributed/selected from the same lottery terminal(s)/location(s) from which winning ticket(s) was/were purchased/distributed/selected (as also called for purposes of this description: community prize(s)). In some embodiments, the exemplary inventive game system(s) of the present invention are configured to result in preserving the winner anonymity by awarding at least one additional prize divided among non-winning tickets/participants/combinations of the same drawing that were purchased/distributed/selected from the same lottery terminal(s)/location(s) from which the winning ticket(s) with the highest prize was/were purchased/distributed/selected (as also called for purposes of this description: community prize(s)). In some embodiments, the exemplary inventive game system(s) of the present invention are configured to result in preserving the winner anonymity by awarding at least one additional prize divided among non-winning tickets/participants/combinations of the same drawing that were purchased/distributed/selected from the same lottery terminal(s)/location(s) from which the winning ticket(s) with at least one predetermined prize was/were purchased/distributed/selected (as also called for purposes of this description: community prize(s)).

In some embodiments, the exemplary inventive game system(s) of the present invention are configured to result in preserving the winner anonymity by awarding at least one additional prize divided among non-winning game participants/combinations of the same game round that played or were played from the same game terminal(s)/location(s) where the winning participant(s)/combination(s) with at least one predetermined prize played or was/were played (as also called for purposes of this description: community prize(s)).

In some embodiments, the exemplary specifically programmed computer system for conducting a game (e.g., a lottery) includes establishing a database of possible game data and area information of points of sale/participation.

In some embodiments, the exemplary inventive game system(s) of the present invention are configured to select/identify at least one community for the community prize(s) based on at least one of the following group of identifiers regarding where the at least one winning tickets/participants/combinations was/were purchased/distributed/selected, or played, or was/were played:

Postcodes
Districts
Suburbs
Coordinates
Place on map
Telephone codes
any other similarly suitable publically announced segmentation set by a lottery/game conducting authority.

In some embodiments, the specifically programmed computer game system defines a winning mode, where a predetermined amount of game data in the winning group coincide with the game data contained in the dispensed tickets. In some embodiments, the game data contained on ticket refer to an existing lottery game. In some embodiments, game data contained on ticket refer to a new lottery game.

In some embodiments, the exemplary inventive game system(s) of the present invention is configured allow each player participating in the same area where the winner of the top prize of the main game has purchased their winning ticket (e.g., but not limited to: an identifier, i.e., postcodes, districts, suburbs, geographic coordinates, telephone codes, etc.) to claim the community prize.

In some embodiments, the exemplary inventive game system(s) of the present invention at least includes a step of address enrichment that include at least processing each record within file(s) and based at least in part on address information add CASS-certified postal 11-digit ZIP code (Delivery Point Code) to each record that identifies an ownership of at least one financial asset by at least one individual and/or a group of related individuals. For example, typically, a ZIP+4 code uses the basic five-digit code plus four additional digits to identify a geographic segment within the five-digit delivery area, such as a city block, a group of apartments, an individual high-volume receiver of mail or any other unit that could use an extra identifier to aid in efficient mail sorting and delivery. In general, mail is read by a multiline optical character reader (MLOCR) that almost instantly determines the correct ZIP+4 code from the address and—along with the even more specific delivery point—sprays a Postnet bar code on the face of the mail piece that corresponds to 11 digits-nine for the ZIP+4 code and two for the delivery point. For example, for Post Office Boxes, the general (but not invariable) rule is that each box has its own ZIP+4 code. The add-on code is often one of the following: the last four digits of the box number (e.g., PO Box 727050, Defreestville N.Y. 12144-7050), zero plus the last three digits of the box number (e.g., PO Box 17727, Eagle River, Ak. 99577-0727), or, if the box number consists of fewer than four digits, enough zeros are attached to the front of the box number to produce a four-digit number (e.g., PO Box 77, Juneau Ak.

99750-0077). At least in some cases, there is no uniform rule, so the ZIP+4 code must be looked up individually for each box.

The CASS certification is performed by the U.S. Postal service. Typically, CASS is offered to all mailers, service bureaus, and software vendors who want to evaluate their address-matching software and improve the quality of their ZIP+4, CRIS, and 5-digit coding accuracy. Typically, this process is graded by the United States Postal Service®, National Customer Support Center (NCSC), and the results returned to mailers in order to provide useful diagnostics for correcting deficiencies, https://www.usps.com/business/certification-programs.htm.

In other embodiments, an exemplary inventive game system of the present invention is configured to allow the winners of a secondary draw conducted among all players participating in the same area (e.g., but not limited to: an identifier, i.e., postcodes, districts, suburbs, geographic coordinates, telephone codes, etc.) the winner of the top prize of the main game has purchased their winning ticket to claim the community prize.

In some embodiments, the exemplary inventive game system is configured to determine a community prize, where the community prize can be fixed/predetermined, thus each winner can receive a pre-determined prize each time, the level of which is known in advance, and/or pool, meaning that a predetermined percentage of the game's sales can be allocated to the winners of the community prize thus the number of community winners can determine the value of the prize (e.g., the more winners the smaller the prize, the fewer winners, the higher the prize).

Illustrative Example for Some Embodiments of the Present Invention

Figure 3:
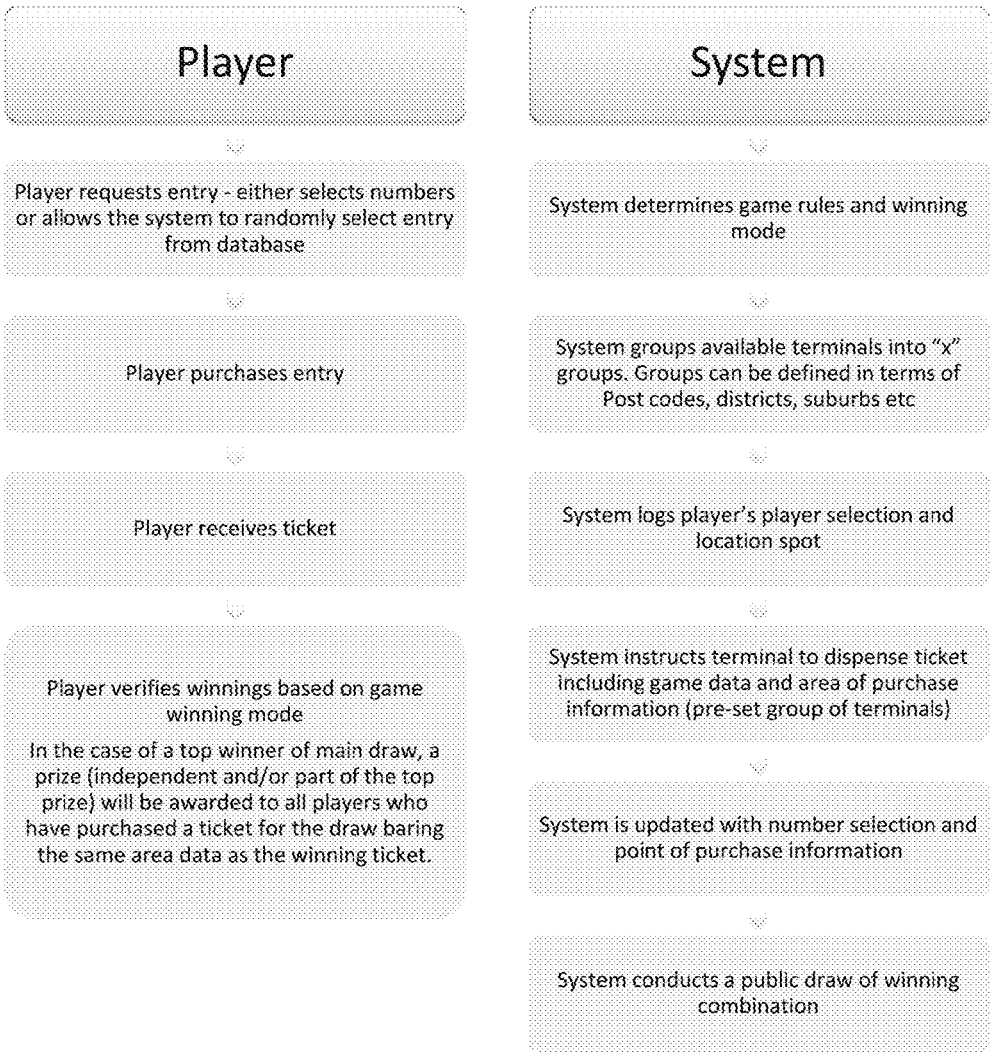
Figure 4:
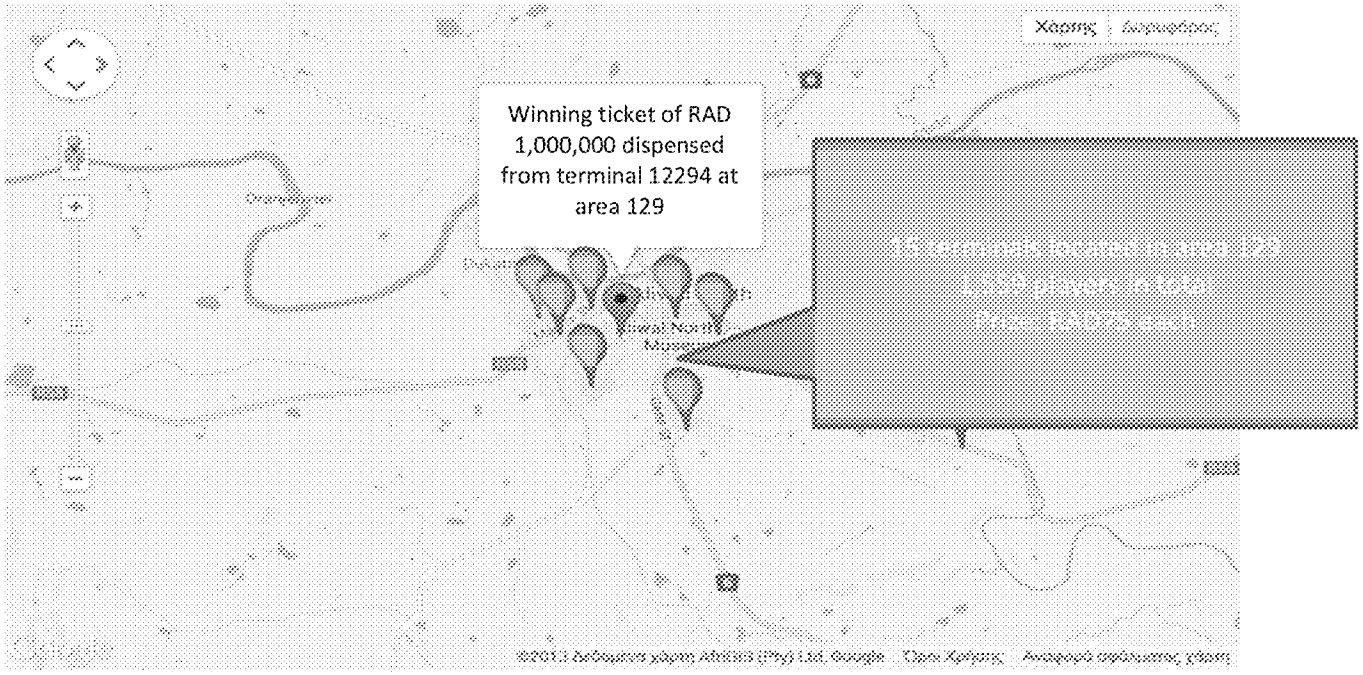

As shown in FIGS. 3 and 4, in some embodiments of the present invention, the game/lottery conducting authority determines game/lottery rules and winning mode/prizes. For example, a pick 7-digit passive lottery/game with winning categories including matching 7, 6, 5, 4, 3, 2, 1 of the digits drawn/played in exact sequence they are drawn/played.

In some embodiments, the exemplary specifically programmed computer game system of the present invention is configured to group available terminals into a specified number of group(s). In some embodiments, for example, groups can be defined in terms of post codes, districts, suburbs, etc. In some embodiments, the groups can include an equal or unequal number of terminals, depending on the business requirements of the lottery/game conducting authority. In embodiment, for example, the number of terminals grouped in a single group could depend, in addition to the location requirements, on the number of players each terminal serves, so as to ensure that all groups formed would address the same or comparable number of players.

In some embodiments, the exemplary inventive game system(s) of the present invention is configured to allow a player to select a 7-digit number or ask for the 7-digit number to be randomly picked from the computer system's database or select one of the pre-printed cards baring 7-digit numbers available at the point of purchase. In some embodiments, the exemplary specifically programmed computer game system receives the player's playing selection and is configured to allow a player to purchase a game/lottery entry.

In some embodiments, the specifically programmed computer game system logs the player's playing selection and a location spot, with the terminal identification code as programmed in the exemplary game system.

In some embodiments, the exemplary inventive game system(s) of the present invention is configured to allow the game/lottery terminal to dispense a ticket(s) including 7-digit number or 7-digit number and the area of purchase information (e.g., a pre-set group of terminals), identified by a number, symbol, word, etc.

In some embodiments, the exemplary specifically programmed computer game system updates the number selection and point of purchase information log.

In some embodiments, the exemplary specifically programmed computer game system of the present invention is configured to conduct a public draw of, e.g., but not limited to, a 7-digit number, the results of which will be communicated by the means specified by the lottery/game conducting authority.

In some embodiments, the exemplary inventive game system(s) of the present invention is configured to allow the player to verify potential winnings based on 7-digit number drawn. In some embodiments, winnings can depend on the amount of digits in place the player correctly matched with the drawn number.

In some embodiments, the exemplary specifically-programmed computer game system of the present invention, is configured to identify/find at least one top winner (when having matched all digits (as a non-limiting example, 7 digits) in exact position), and a community prize (independent or part of the top prize) will be awarded to all players who have purchased a ticket for the draw having the same area data as the winning ticket. In some embodiments of the specifically programmed computer game system of the present invention, a community prize will be awarded only to players who purchased a ticket for a draw having the same area data as the top winner's data, but have not won any prize in the main game.

In some embodiments of the exemplary inventive game system of the present invention, when a top winner (having matched all digits (as a non-limiting example, 7 digits) in exact position) is identified by the game system, a second draw will be conducted among all players who have purchased a ticket for the draw baring the same identifier (e.g., but not limited to, postcode data) as the winning ticket of the top winner and the second winner(s) will be awarded a lesser community prize. In some embodiments, entries for the secondary draw will be awarded only to each player who purchased a ticket for a draw having the same area data as the top winner's data, but have not won any prize in the main game.

In some embodiments, exemplary inventive game systems of the present invention are configured to utilize at least one of the following factors in determining the community(ies) of participants and/or the community prize(s):

- Number of groups formed
- Current playing population per group
- Expected participation
- Top winner frequency
- Estimated prize level appealing to players
- Risk management strategy in case projections are exceeded; and
- Payout Distribution.

In some embodiments, the specifically programmed computer game system is configured to utilize at least one of the following methodologies to calculate the community prize(s).

Illustrative Example #1 of Community Award(s) Methodology

In some embodiments, the exemplary inventive game system(s) of the present invention is configured to allocate the additional percentage of the game sales to the community prize(s). As detailed in FIG. 5, for example, in the instance of Powerball, 50% of the game sales are allocated to the main game's 9 winning categories. For example, the community prize is an additional percentage of the sales, eg. 2%, that is automatically allocated, based on predetermined rules, from the game's sales to fund the community prize, making the total payout to the players 52% and allowing all the prizes of the main game winning categories to be preserved at current levels.

In some embodiments, the exemplary inventive game system of the present invention is configured to allocate the payout to the community prize, of which allocation could be at least one of:

- a percentage of the draw sales of the entire Lottery jurisdiction;
- a percentage of the draw sales in only a particular geographic region where the winning ticket was purchased/selected, and
- a fixed percentage of all draw sales taken from each drawing until a top winner of the main game is found.

Illustrative Example #2 of Community Award(s) Methodology

In some embodiments, the exemplary specifically programmed computer game system of the present invention can be configured to re-allocate a percentage of the payout distributed to secondary/lower winning categories of the main game in order to distribute the community prize. As illustrated for example in FIG. 6, in the case of Powerball, some or all secondary prizes in the 9 winning categories can be reduced in order to allocate a portion of the payout to the community prize (s) (compare to FIG. 5).

In some embodiments, the exemplary inventive game system of the present invention is configured to allow the financing of the community prize(s) to be accomplished by increasing the participation price (e.g., in the case of Powerball, a player pays an extra $1 ($3 in total, in addition to the regular fee of $2) that is allocated fund, in part or in full, the community prize).

In some embodiments, the exemplary inventive game system(s) of the present invention is configured to allow for biding/sponsoring of community prize(s) by 3rd party individuals and businesses as promotions instead of utilizing the game/lottery proceeds to pay for the community prize(s). In some embodiments, the exemplary inventive game system(s) of the present invention allows for biding/sponsoring of community prize(s) by 3rd party individuals and businesses as promotions in addition to utilizing the game/lottery proceeds to pay for the community prize(s).

In some embodiments, the exemplary inventive game system(s) of the present invention is configured to allow a game/lottery organizer to utilize a combination of various funding methodologies to fund the community prize(s).

Illustrative Operating Environments

In some embodiments, the innovative programmed systems can be operated over other operating systems, such as, but not limited to, iOS and Android. In some embodiments, the innovative programmed systems can be native to a software platform and/or incorporate programming modules based at least in part on HTML5-based tools like PhoneGap or Sencha. In some embodiments, the innovative programmed systems can include modules that are programmed to provide intelligent dynamic promotion and advertising, mobile payments, augmented reality, etc.

FIG. 1 illustrates one embodiment of an environment in which the present invention may operate. However, not all of these components may be required to practice the invention, and variations in the arrangement and type of the components may be made without departing from the spirit or scope of the invention. In some embodiment, the inventive game system for conducting a game hosts a large number of members/participants/players (e.g., at least 1,000, at least 10,000; at least 100,000; at least 1,000,000) and/or concurrent transactions/tickets/combinations (e.g., at least 1,000; at least 10,000; at least 100,000; at least 1,000,000). In other embodiments, the inventive game system for conducting a game is based on a scalable computer and network architecture that incorporates varies strategies for assessing the data, caching, searching, and database connection pooling. An example of the scalable architecture is an architecture that is capable of operating multiple servers.

In embodiments, members of the inventive computer system 102-104 (e.g. user (e.g. players, agents, etc.) include virtually any computing device capable of receiving and sending a message over a network, such as network 105, to and from another computing device, such as servers 106 and 107, each other, and the like. In embodiments, the set of such devices includes devices that typically connect using a wired communications medium such as personal computers, multiprocessor systems, microprocessor-based or programmable consumer electronics, network PCs, and the like. In embodiments, the set of such devices also includes devices that typically connect using a wireless communications medium such as cell phones, smart phones, pagers, walkie talkies, radio frequency (RF) devices, infrared (IR) devices, CBs, integrated devices combining one or more of the preceding devices, or virtually any mobile device, and the like. Similarly, in embodiments, client devices 102-104 are any device that is capable of connecting using a wired or wireless communication medium such as a PDA, POCKET PC, wearable computer, and any other device that is equipped to communicate over a wired and/or wireless communication medium.

In embodiments, each member device within member devices 102-104 may include a browser application that is configured to receive and to send web pages, and the like. In embodiments, the browser application may be configured to receive and display graphics, text, multimedia, and the like, employing virtually any web based language, including, but not limited to Standard Generalized Markup Language (SMGL), such as HyperText Markup Language (HTML), a wireless application protocol (WAP), a Handheld Device Markup Language (HDML), such as Wireless Markup Language (WML), WMLScript, JavaScript, and the like. In embodiments, the invention is programmed in either Java or .Net.

In embodiments, member devices 102-104 may be further configured to receive a message from the another computing device employing another mechanism, including, but not limited to email, Short Message Service (SMS), Multimedia Message Service (MMS), instant messaging (IM), internet relay chat (IRC), mIRC, Jabber, and the like.

In embodiments, network 105 may be configured to couple one computing device to another computing device to enable them to communicate. In embodiments, network 105 may be enabled to employ any form of computer readable media for communicating information from one electronic device to another. Also, in embodiments, network 105 may include a wireless interface, and/or a wired interface, such as the Internet, in addition to local area networks (LANs), wide area networks (WANs), direct connections, such as through a universal serial bus (USB) port, other forms of computer-readable media, or any combination thereof. In embodiments, on an interconnected set of LANs, including those based on differing architectures and protocols, a router may act as a link between LANs, enabling messages to be sent from one to another.

Also, in some embodiments, communication links within LANs typically include twisted wire pair or coaxial cable, while communication links between networks may utilize analog telephone lines, full or fractional dedicated digital lines including T1, T2, T3, and T4, Integrated Services Digital Networks (ISDNs), Digital Subscriber Lines (DSLs), wireless links including satellite links, or other communications links known to those skilled in the art. Furthermore, in some embodiments, remote computers and other related electronic devices could be remotely connected to either LANs or WANs via a modem and temporary telephone link. In essence, in some embodiments, network 105 includes any communication method by which information may travel between client devices 102-104, and servers 106 and 107.

Figure 2:
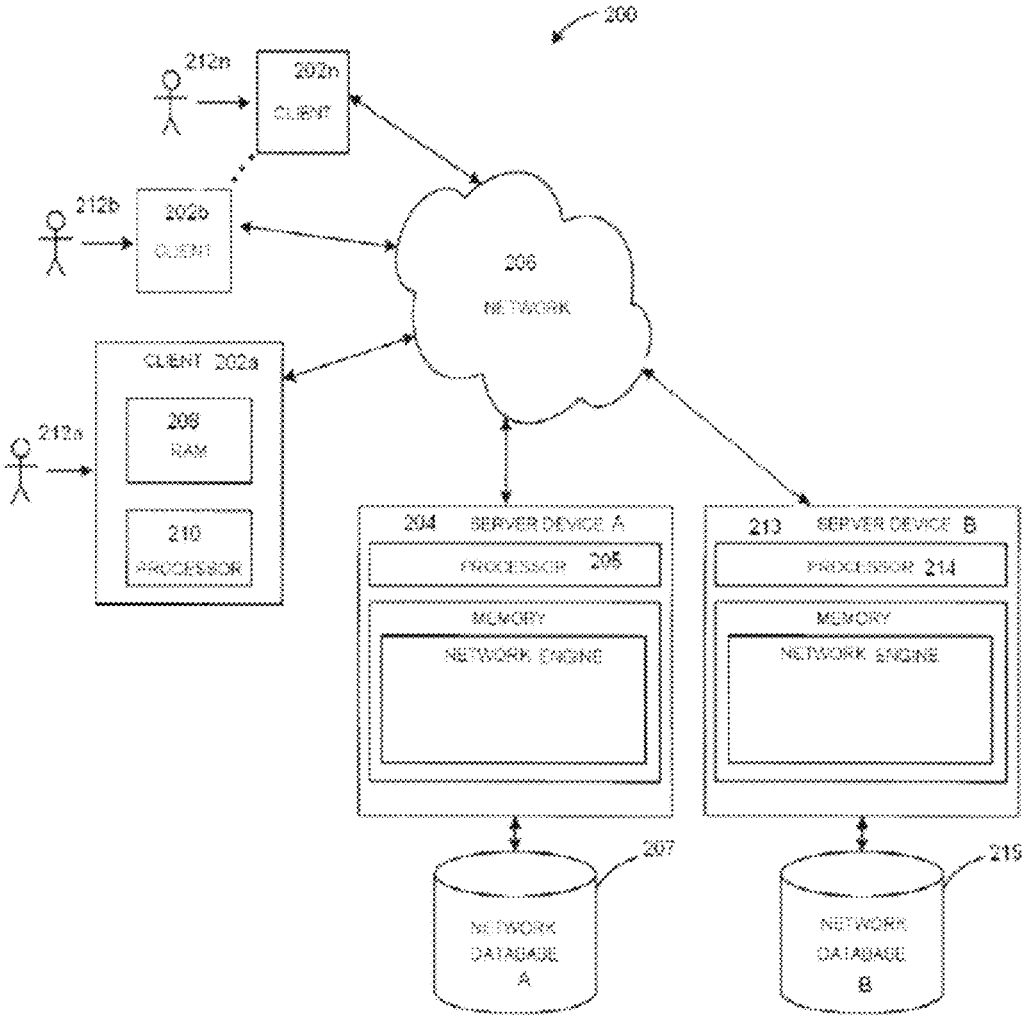

FIG. 2 shows another exemplary embodiment of the computer and network architecture that supports the inventive game system for conducting a game. The member devices 202*a*, 202*b* thru 202*n* shown (e.g., lottery terminals, players' personal electronic devices) each at least includes a computer-readable medium, such as a random access memory (RAM) 208 coupled to a processor 210 or FLASH memory. The processor 210 may execute computer-executable program instructions stored in memory 208. Such processors comprise a microprocessor, an ASIC, and state machines. Such processors comprise, or may be in communication with, media, for example computer-readable media, which stores instructions that, when executed by the processor, cause the processor to perform the steps described herein. Embodiments of computer-readable media may include, but are not limited to, an electronic, optical, magnetic, or other storage or transmission device capable of providing a processor, such as the processor 210 of client 202*a*, with computer-readable instructions. Other examples of suitable media may include, but are not limited to, a floppy disk, CD-ROM, DVD, magnetic disk, memory chip, ROM, RAM, an ASIC, a configured processor, all optical media, all magnetic tape or other magnetic media, or any other medium from which a computer processor can read instructions. Also, various other forms of computer-readable media may transmit or carry instructions to a computer, including a router, private or public network, or other transmission device or channel, both wired and wireless. The instructions may comprise code from any computer-programming language, including, for example, C, C++, C#, Visual Basic, Java, Python, Perl, and JavaScript.

Member devices 202*a-n* may also comprise a number of external or internal devices such as a mouse, a CD-ROM, DVD, a keyboard, a display, or other input or output devices. Examples of client devices 202*a-n* may be personal computers, digital assistants, personal digital assistants, cellular phones, mobile phones, smart phones, pagers, digital tablets, laptop computers, Internet appliances, and other processor-based devices. In general, a client device 202*a* are be any type of processor-based platform that is connected to a network 206 and that interacts with one or more application programs. Client devices 202*a-n* may operate on any operating system capable of supporting a browser or browser-enabled application, such as Microsoft™, Windows™, or Linux. The client devices 202*a-n* shown may include, for example, personal computers executing a browser application program such as Microsoft Corporation's Internet Explorer™, Apple Computer, Inc.'s Safari™, Mozilla Firefox, and Opera. Through the client devices 202*a-n*, users (e.g. players, agents, etc.) 212*a-n* communicate over the network 206 with each other and with other systems and devices coupled to the network 206. As shown in FIG. 2, server devices 204 and 213 may be also coupled to the network 206.

In some embodiments, the term "mobile electronic device" may refer to any portable electronic device that may or may not be enabled with location tracking functionality. For example, a mobile electronic device can include, but is not limited to, a mobile phone, Personal Digital Assistant (PDA), Blackberry™, Pager, Smartphone, or any other reasonable mobile electronic device. For ease, at times the above variations are not listed or are only partially listed, this is in no way meant to be a limitation.

In some embodiments, the terms "proximity detection," "locating," "location data," "location information," and "location tracking" as used herein may refer to any form of location tracking technology or locating method that can be used to provide a location of a mobile electronic device, such as, but not limited to, at least one of location information manually input by a user, such as, but not limited to entering the city, town, municipality, zip code, area code, cross streets, or by any other reasonable entry to determine a geographical area; Global Positions Systems (GPS); GPS accessed using Bluetooth™; GPS accessed using any reasonable form of wireless and/or non-wireless communication; WiFi™ server location data; Bluetooth™ based location data; triangulation such as, but not limited to, network based triangulation, WiFi™ server information based triangulation, Bluetooth™ server information based triangulation; Cell Identification based triangulation, Enhanced Cell Identification based triangulation, Uplink-Time difference of arrival (U-TDOA) based triangulation, Time of arrival (TOA) based triangulation, Angle of arrival (AOA) based triangulation; techniques and systems using a geographic coordinate system such as, but not limited to, longitudinal and latitudinal based, geodesic height based, cartesian coordinates based; Radio Frequency Identification such as, but not limited to, Long range RFID, Short range RFID; using any form of RFID tag such as, but not limited to active RFID tags, passive RFID tags, battery assisted passive RFID tags; or any other reasonable way to determine location. For ease, at times the above variations are not listed or are only partially listed, this is in no way meant to be a limitation.

In some embodiments, NFC can represent a short-range wireless communications technology in which NFC-enabled devices are "swiped," "bumped," "tap" or otherwise moved in close proximity to communicate. In some embodiments, NFC could include a set of short-range wireless technologies, typically requiring a distance of 10 cm or less.

In some embodiment, NFC can operates at 13.56 MHz on ISO/IEC 18000-3 air interface and at rates ranging from 106 kbit/s to 424 kbit/s. In some embodiments, NFC can involve an initiator and a target; the initiator actively generates an RF field that can power a passive target. In some embodiment, this can enable NFC targets to take very simple form factors such as tags, stickers, key fobs, or cards that do not require batteries. In some embodiments, NFC peer-to-peer communication can be conducted when a plurality of NFC-enable device within close proximity of each other.

In some embodiments, NFC tags can contain data and be read-only or rewriteable. In some embodiment, NFC tags can be custom-encoded. In some embodiments, NFC tags and/or NFC-enabled device (e.g., smart phones with NFC capabilities) can securely store personal data such as debit and credit card information, loyalty program data, PINs and networking contacts, among other information.

In some embodiments, lottery data may also be communicated using any wireless means of communication, such as 4G, 3G, GSM, GPRS, WiFi, WiMax, and other remote local or remote wireless communication using information obtained via the interfacing of a wireless NFC enabled mobile device to a smart poster. In some embodiments, the term "wireless communications" includes communications conducted at ISO 14443 and ISO 18092 interfaces. In some embodiments, the communications between player's NFC-enabled smart device and lottery provided equipment (e.g., terminals, POS, POE, Hosts) is performed, for example, in accordance with the ISO 14443A/B standard and/or the ISO 18092 standard.

In some embodiments, player's NFC-enabled smart device and/or lottery provided equipment (e.g., terminals, POS, POE, Hosts) can include one or more additional transceivers (e.g., radio, Bluetooth, and/or WiFi transceivers) and associated antennas, and enabled to communicate with each other by way of one or more mobile and/or wireless protocols.

In some embodiments, NFC tags can include one or more integrated circuits.

In some embodiments, player's NFC-enabled smart device may include a cellular transceiver coupled to the processor and receiving a cellular network timing signal. In some embodiments, player's NFC-enabled smart device may further include a satellite positioning receiver coupled to the processor and receiving a satellite positioning system timing signal, and the processor may accordingly be configured to synchronize the internal timing signal to the satellite positioning system timing signal as the external timing signal. In some embodiments, the processor of player's NFC-enabled smart device may be configured to synchronize the internal timing signal to the common external system timing signal via the NFC circuit.

In some embodiments, player's NFC-enabled smart device may include a power source, an NFC circuit configured to wirelessly communicate using an NFC communications protocol, and a processor coupled to the power source and the NFC circuit. In some embodiments, the processor of player's NFC-enabled smart device may be configured to synchronize an internal timing signal to an external timing signal, cycle power to the NFC circuit to periodically switch the NFC circuit between a peer-to-peer recognition state and a low power state based upon the synchronized internal timing signal, and initiate peer-to-peer NFC communications with another NFC device when in range thereof and upon being simultaneously switched to the peer-to-peer recognition state therewith.

In some embodiments, player's NFC-enabled smart device may include a related physical computer-readable medium and may have computer-executable instructions for causing player's NFC-enabled smart device to initiating peer-to-peer NFC communications with another NFC device when in range thereof and upon being simultaneously switched to the peer-to-peer recognition state therewith.

In some embodiments, the processor of player's NFC-enabled smart device may be configured for communicating wireless voice and data via a cellular transceiver via a cellular communications network. By way of example, the data communications may include, but not limited to, email messages, Web data, etc. In some embodiments, player's NFC-enabled smart device may in addition (or instead) include other types of wireless communications circuits capable of transmitting voice or other data, such as a wireless LAN, WiMAX, etc., circuit. In some embodiments, the processor of player's NFC-enabled smart device may proceed directly to communicate with the trusted NFC device, and in the case of a "smart poster" NFC device (e.g., SLP/SLS), such as one configured to pass a Uniform Resource Locator (URL), the processor may automatically direct a browser application thereof to the URL without prompting for permission to proceed to the designated location.

Illustrative Examples for Conducting and Participating in Lottery Games

Example 1

In some embodiments, lottery games of the present invention are conducted utilizing NFC devices that can include, but are not limited to, one or more Smart Lottery Poster (SLP) or a Smart Lottery Spot ("SLS") having one or more wireless tags ("NFC tags"). In some embodiments, NFC tagged spots (SLP, SLS) can be in one or more of the following formats or other: wall posters, street posters, POS (point of service locations), terminals, newspapers, magazines, NFC-enabled TV, etc.

In some embodiments, players' NFC-enabled devices selectively recognize only certain NFC tagged spots (SLP, SLS or other NFC-tagged spots in cooperation with the Lottery Host) and disregard others (e.g., NFC tagged spots belonging to a particular retailer).

In some embodiments, NFC taps location must be known by the lottery host system.

In some embodiments, players' NFC-enabled devices must be enabled for mobile client tracking.

In some embodiments, one or more NFC tags can be arranged on a SLP in a particular grid arrangement. In some embodiments, the NFC tags can be overlaid with an artistic drawing, so that, for example, on top of each tag one corresponding lottery game indicia, e.g. number, is shown. In some embodiments, each NFC tag can be assigned the lottery indicia, e.g. shown over it on the overlay. In some embodiments, the NFC tags (and therefore their respective indicia, e.g. numbers) can be arranged in an orderly manner on the grid, for example following a numeric order.

In some embodiments, a potential player of lottery, who owns an NFC-enabled personal device (mobile phone, PDA, tablet etc) and wishes to participate in a lottery game, can walk up to a NFC spot, e.g. SLP, and select their lottery participation options by bringing the NFC device in a proximity to (or tap on) the desired indicia, e.g. number(s), on the SLP, one by one. In some embodiments, this action can be repeated for as many indicia, e.g. numbers, as desired. In some embodiments, during the process of communicating with the SLS, the NFC-enabled device will interrogate for the proximity of an NFC tag, and, if a tag is detected, the tag is interrogated about its number assignment. In some embodiments, the NFC tag can respond with a lottery indicia, e.g. number, assigned to it and the device can store the tag responses (and therefore the player selections) using a software programmed to receive and communicate information utilizing NFC protocols. In some embodiments, a set of selected numbers can be used to create an electronic lottery play slip which can then be transferred to a lottery conducting agency for validation, using, for example, an electronic message, or a barcode formed on the device screen, or any other suitable technologies.

Figure 7:
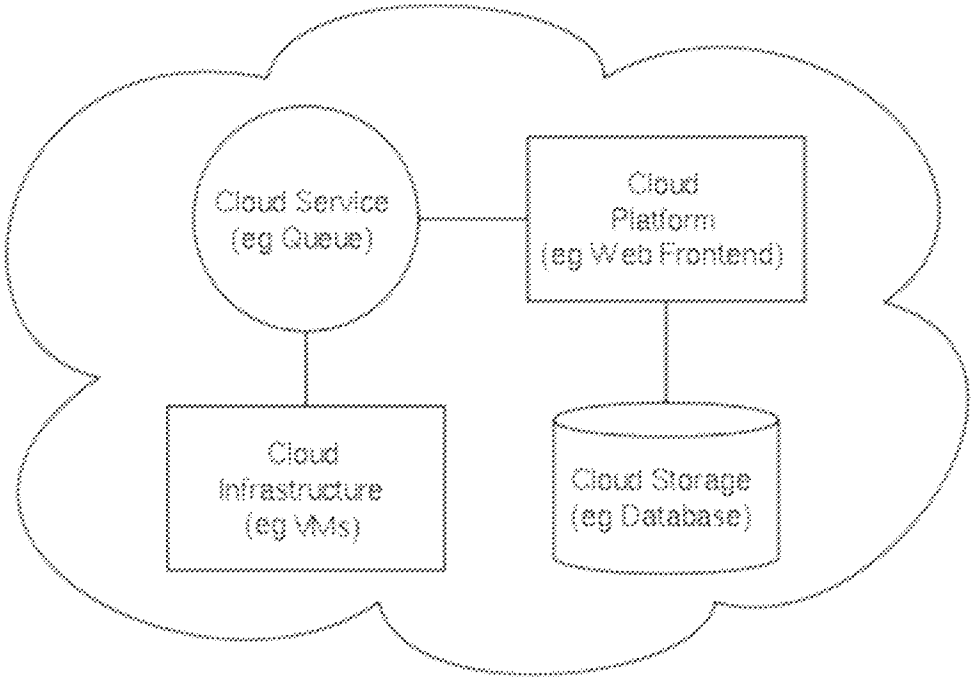
Figure 8:
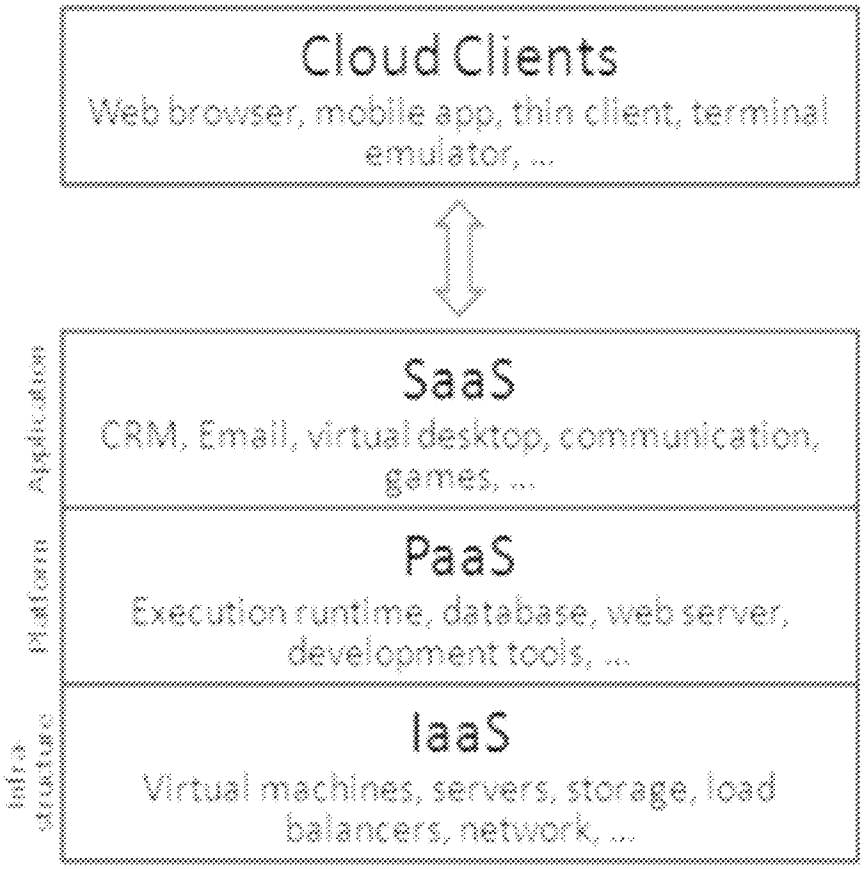

For purposes of the instant description, the terms "cloud," "Internet cloud," "cloud computing," "cloud architecture," and similar terms correspond to at least one of the following: (1) a large number of computers connected through a real-time communication network (e.g., Internet); (2) providing the ability to run a program or application on many connected computers (e.g., physical machines, virtual machines (VMs)) at the same time; (3) network-based services, which appear to be provided by real server hardware, and are in fact served up by virtual hardware (e.g., virtual servers), simulated by software running on one or more real machines (e.g., allowing to be moved around and scaled up (or down) on the fly without affecting the end user). In some embodiments, the instant invention offers/manages the cloud computing/architecture as, but not limiting to: infrastructure a service (IaaS), platform as a service (PaaS), and software as a service (SaaS). FIGS. 7 and 8 illustrate schematics of exemplary implementations of the cloud computing/architecture.

Of note, the embodiments described herein may, of course, be implemented using any appropriate computer system hardware and/or computer system software. In this regard, those of ordinary skill in the art are well versed in the type of computer hardware that may be used (e.g., a mainframe, a mini-computer, a personal computer ("PC"), a network (e.g., an intranet and/or the internet)), the type of computer programming techniques that may be used (e.g., object oriented programming), and the type of computer programming languages that may be used (e.g., C++, Basic, AJAX, Javascript). The aforementioned examples are, of course, illustrative and not restrictive.

In some embodiments, the present invention provides for a game-operating computer system, including: at least one server and software stored on a non-transient computer readable medium accessible by the at least one server, where the software is at least configured to: (a) conduct the game drawing; (b) determine at least one winning ticket based on the game drawing; (c) identify at least one winning purchase location of the at least one winning ticket of the game drawing; (d) identify at least one pool of non-winning players based on the at least one winning purchase location of the at least one winning ticket of the game drawing; (i) where the at least one pool of non-winning players is determined by at least one identifier, (ii) where the at least one identifier is based on at least one geographic identifier associated with at least one of: 1) a residence of a non-winning player, 2) a location of a non-winning player, 3) a purchase location utilized by a non-winning player to purchase a non-winning ticket, and 4) any combination thereof, (iii) where the at least one geographic identifier is selected from a group consisting of: a postcode identifier, a district identifier, a suburb identifier, a mapped location identifier, a telephone code identifier, geographic coordinate identifier, pre-determined geographic identifier set by a game conducting authority, and any combination thereof, and (e) calculate a community prize based on: 1) the at least one pool of non-winning players, 2) draw sales, and 3) a prize amount allocated to the at least one winning ticket; (f) divide the community prize based on a number of non-winning tickets in the at least one pool of non-winning players to determine a plurality of non-winning prizes; (g) award the plurality of non-winning prizes to the at least one pool of non-winning players; and (h) cause to display, via a specifically programmed graphical user interface, a notification about each of the plurality of non-winning prizes to each non-winning player of the pool of non-winning players.

In some embodiments, the game drawing is a lottery. In some embodiments, the non-winning player chooses between 1 and 5 of 6 winning numbers. In some embodiments, the non-winning player chooses between 1 and 4 of 5 winning numbers. In some embodiments, the pool of non-winning players is at least a thousand non-winning players. In some embodiments, the draw sales are at least partially funded from at least one previous game drawing.

In some embodiments, the instant invention provides for a game-operating computer system, including: at least one server and software stored on a non-transient computer readable medium accessible by the at least one server, where the software is at least configured to: (a) conduct the game drawing; (b) determine at least one winning ticket based on the game drawing; (c) identify at least one winning purchase location of the at least one winning ticket of the game drawing; (d) identify at least one pool of non-winning players based on the at least one winning purchase location of the at least one winning ticket of the game drawing; (i) where the at least one pool of non-winning players is determined by at least one identifier, (ii) where the at least one identifier is based on at least one geographic identifier associated with at least one of: 1) a residence of a non-winning player, 2) a location of a non-winning player, 3) a purchase location utilized by a non-winning player to purchase a non-winning ticket, and 4) any combination thereof, (iii) where the at least one geographic identifier is selected from a group consisting of: a postcode identifier, a district identifier, a suburb identifier, a mapped location identifier, a telephone code identifier, geographic coordinate identifier, pre-determined geographic identifier set by a game conducting authority, and any combination thereof, and (e) calculate a community prize based on: 1) the at least one pool of non-winning players, 2) draw sales, and 3) a prize amount allocated to the at least one winning ticket; (f) divide the community prize based on a predetermined number to generate a plurality of non-winning prizes; (g) award the plurality of non-winning prizes to the at least one pool of non-winning players; and (h) cause to display, via a specifically programmed graphical user interface, a notification about each of the plurality of non-winning prizes to each non-winning player of the pool of non-winning players.

In some embodiments, the game drawing is a lottery. In some embodiments, the non-winning player chooses between 1 and 5 of 6 winning numbers. In some embodiments, the non-winning player chooses between 1 and 4 of 5 winning numbers. In some embodiments, the pool of non-winning players is at least a thousand non-winning players. In some embodiments, the draw sales are at least partially funded from at least one previous game drawing.

In some embodiments, the instant invention provides for a game-operating computer method, including: (a) conducting, by at least one server, the game drawing; (b) determining, by the at least one server, at least one winning ticket based on the game drawing; (c) identifying, by the at least one server, at least one winning purchase location of the at least one winning ticket of the game drawing; (d) identifying, by the at least one server, at least one pool of non-winning players based on the at least one winning purchase location of the at least one winning ticket of the game drawing; (i) where the at least one pool of non-winning players is determined by at least one identifier, (ii) where the at least one identifier is based on at least one geographic identifier associated with at least one of: 1) a residence of a non-winning player, 2) a location of a non-winning player, 3) a purchase location utilized by a non-winning player to purchase a non-winning ticket, and 4) any combination thereof, (iii) where the at least one geographic identifier is selected from a group consisting of: a postcode identifier, a district identifier, a suburb identifier, a mapped location identifier, a telephone code identifier, geographic coordinate identifier, pre-determined geographic identifier set by a game conducting authority, and any combination thereof, and (e) calculating, by the at least one server, a community prize based on: 1) the at least one pool of non-winning players, 2) draw sales, and 3) a prize amount allocated to the at least one winning ticket; (f) dividing, by the at least one server, the community prize based on a number of non-winning tickets in the at least one pool of non-winning players to determine a plurality of non-winning prizes; (g) awarding, by the at least one server, the plurality of non-winning prizes to the at least one pool of non-winning players; and (h) causing to display, by the at least one server, via a specifically programmed graphical user interface, a notification about each of the plurality of non-winning prizes to each non-winning player of the pool of non-winning players.

In some embodiments, the game drawing is a lottery. In some embodiments, the non-winning player chooses between 1 and 5 of 6 winning numbers. In some embodiments, the non-winning player chooses between 1 and 4 of 5 winning numbers. In some embodiments, the pool of non-winning players is at least a thousand non-winning players. In some embodiments, the draw sales are at least partially funded from at least one previous game drawing.

In some embodiments, the instant invention provides for a game-operating computer method, including: (a) conducting, by at least one server, the game drawing; (b) determining, by the at least one server, at least one winning ticket based on the game drawing; (c) identifying, by the at least one server, at least one winning purchase location of the at least one winning ticket of the game drawing; (d) identifying, by the at least one server, at least one pool of non-winning players based on the at least one winning purchase location of the at least one winning ticket of the game drawing; (i) where the at least one pool of non-winning players is determined by at least one identifier, (ii) where the at least one identifier is based on at least one geographic identifier associated with at least one of: 1) a residence of a non-winning player, 2) a location of a non-winning player, 3) a purchase location utilized by a non-winning player to purchase a non-winning ticket, and 4) any combination thereof, (iii) where the at least one geographic identifier is selected from a group consisting of: a postcode identifier, a district identifier, a suburb identifier, a mapped location identifier, a telephone code identifier, geographic coordinate identifier, pre-determined geographic identifier set by a game conducting authority, and any combination thereof, and (e) calculating, by the at least one server, a community prize based on: 1) the at least one pool of non-winning players, 2) draw sales, and 3) a prize amount allocated to the at least one winning ticket; (f) dividing, by the at least one server, the community prize based on a predetermined number to generate a plurality of non-winning prizes; (g) awarding, by the at least one server, the plurality of non-winning prizes to the at least one pool of non-winning players; and (h) causing to display, by the at least one server, via a specifically programmed graphical user interface, a notification about each of the plurality of non-winning prizes to each non-winning player of the pool of non-winning players.

In some embodiments, the game drawing is a lottery. In some embodiments, the non-winning player chooses between 1 and 5 of 6 winning numbers. In some embodiments, the non-winning player chooses between 1 and 4 of 5 winning numbers. In some embodiments, the pool of non-winning players is at least a thousand non-winning players. In some embodiments, the draw sales are at least partially funded from at least one previous game drawing.

While a number of embodiments of the present invention have been described, it is understood that these embodiments are illustrative only, and not restrictive, and that many modifications may become apparent to those of ordinary skill in the art.

What is claimed is:

1. A game-operating computer system, comprising:

at least one server and software stored on a non-transient computer readable medium accessible by the at least one server, wherein the software is at least configured to:

electronically receive, in real time, data about at least one game drawing, involving at least a thousand players;

dynamically determine at least one winning purchase location of at least one winning ticket of the game drawing;

dynamically identify at least one pool of non-winning players based on the at least one winning purchase location of the at least one winning ticket of the game drawing;

i. wherein the at least one pool of non-winning players is determined by at least one identifier, ii. wherein the at least one identifier is based on at least one geographic identifier associated with at least one of:

1) a residence of a non-winning player, 2) a location of a non-winning player, 3) a purchase location utilized by a non-winning player to purchase a non-winning ticket, and 4) any combination thereof, iii. wherein the at least one geographic identifier is selected from a group consisting of: a postcode identifier, a district identifier, a suburb identifier, a mapped location identifier, a telephone code identifier, geographic coordinate identifier, pre-determined geographic identifier set by a game conducting authority, and any combination thereof, and dynamically calculate a community prize based on:

1) the at least one pool of non-winning players, 2) draw sales, and 3) a prize amount allocated to the at least one winning ticket;

dynamically divide the community prize based on a number of non-winning tickets in the at least one pool of non-winning players to determine a plurality of non-winning prizes;

dynamically award the plurality of non-winning prizes to the at least one pool of non-winning players; and dynamically cause to display, via a specifically programmed graphical user interface, a notification about a particular non-winning prize of the plurality of non-winning prizes to a particular non-winning player of the pool of non-winning players.

2. The game-operating computer system of claim 1, wherein the game drawing is a lottery.

3. The game-operating computer system of claim 2, wherein each of non-winning player is a player who picked between 1 and 5 of 6 winning numbers.

4. The game-operating computer system of claim 2, wherein each of non-winning player is a player who picked between 1 and 4 of 5 winning numbers.

5. The game-operating computer system of claim 1, wherein the draw sales are at least partially funded from at least one previous game drawing.

6. A game-operating computer system, comprising:

at least one server and software stored on a non-transient computer readable medium accessible by the at least one server, wherein the software is at least configured to:

electronically receive data about at least one game drawing, involving at least a thousand players;

dynamically determine least one winning purchase location of at least one winning ticket of the game drawing;

dynamically identify at least one pool of non-winning players based on the at least one winning purchase location of the at least one winning ticket of the game drawing;

i. wherein the at least one pool of non-winning players is determined by at least one identifier, ii. wherein the at least one identifier is based on at least one geographic identifier associated with at least one of:

1) a residence of a non-winning player, 2) a location of a non-winning player, 3) a purchase location utilized by a non-winning player to purchase a non-winning ticket, and 4) any combination thereof, iii. wherein the at least one geographic identifier is selected from a group consisting of: a postcode identifier, a district identifier, a suburb identifier, a mapped location identifier, a telephone code identifier, geographic coordinate identifier, pre-determined geographic identifier set by a game conducting authority, and any combination thereof, and dynamically calculate a community prize based on:

1) the at least one pool of non-winning players, 2) draw sales, and 3) a prize amount allocated to the at least one winning ticket;

dynamically divide the community prize based on a predetermined number to generate a plurality of non-winning prizes;

dynamically award the plurality of non-winning prizes to the at least one pool of non-winning players; and dynamically cause to display, via a specifically programmed graphical user interface, a notification about a particular non-winning prize of the plurality of non-winning prizes to a particular non-winning player of the pool of non-winning players.

7. The game-operating computer system of claim 6, wherein the game drawing is a lottery.

8. The game-operating computer system of claim 7, wherein each of non-winning player is a player who picked between 1 and 5 of 6 winning numbers.

9. The game-operating computer system of claim 7, wherein each of non-winning player is a player who picked between 1 and 4 of 5 winning numbers.

10. The game-operating computer system of claim 6, wherein the draw sales are at least partially funded from at least one previous game drawing.

11. A game-operating computer method, comprising:

electronically receiving, in real time, by at least one server, data about at least one the game drawing, involving at least a thousand players;

dynamically determining, by the at least one server, at least one winning purchase location of at least one winning ticket of the game drawing;

dynamically identifying, by the at least one server, at least one pool of non-winning players based on the at least one winning purchase location of the at least one winning ticket of the game drawing;

i. wherein the at least one pool of non-winning players is determined by at least one identifier, ii. wherein the at least one identifier is based on at least one geographic identifier associated with at least one of:

1) a residence of a non-winning player, 2) a location of a non-winning player, 3) a purchase location utilized by a non-winning player to purchase a non-winning ticket, and 4) any combination thereof, iii. wherein the at least one geographic identifier is selected from a group consisting of: a postcode identifier, a district identifier, a suburb identifier, a mapped location identifier, a telephone code identifier, geographic coordinate identifier, pre-determined geographic identifier set by a game conducting authority, and any combination thereof, and dynamically calculating, by the at least one server, a community prize based on:

1) the at least one pool of non-winning players, 2) draw sales, and 3) a prize amount allocated to the at least one winning ticket;

dynamically dividing, by the at least one server, the community prize based on a number of non-winning tickets in the at least one pool of non-winning players to determine a plurality of non-winning prizes;

dynamically awarding, by the at least one server, the plurality of non-winning prizes to the at least one pool of non-winning players; and dynamically causing to display, by the at least one server, via a specifically programmed graphical user interface, a notification about a particular non-winning prize of the plurality of non-winning prizes to a particular non-winning player of the pool of non-winning players.

12. The game-operating computer method of claim 11, wherein the game drawing is a lottery.

13. The game-operating computer method of claim 12, wherein each of non-winning player is a player who picked between 1 and 5 of 6 winning numbers.

14. The game-operating computer method of claim 12, wherein each of non-winning player is a player who picked between 1 and 4 of 5 winning numbers.

15. The game-operating computer method of claim 11, wherein the draw sales are at least partially funded from at least one previous game drawing.

16. A game-operating computer method, comprising:

electronically receiving, in real time, by at least one server, data about at least one game drawing, involving at least a thousand players;

dynamically determining, by the at least one server, at least one winning purchase location of at least one winning ticket of the game drawing;

dynamically identifying, by the at least one server, at least one pool of non-winning players based on the at least one winning purchase location of the at least one winning ticket of the game drawing;

i. wherein the at least one pool of non-winning players is determined by at least one identifier, ii. wherein the at least one identifier is based on at least one geographic identifier associated with at least one of:

1) a residence of a non-winning player, 2) a location of a non-winning player, 3) a purchase location utilized by a non-winning player to purchase a non-winning ticket, and 4) any combination thereof, iii. wherein the at least one geographic identifier is selected from a group consisting of: a postcode identifier, a district identifier, a suburb identifier, a mapped location identifier, a telephone code identifier, geographic coordinate identifier, pre-determined geographic identifier set by a game conducting authority, and any combination thereof, and dynamically calculating, by the at least one server, a community prize based on:

1) the at least one pool of non-winning players, 2) draw sales, and 3) a prize amount allocated to the at least one winning ticket;

dynamically dividing, by the at least one server, the community prize based on a predetermined number to generate a plurality of non-winning prizes;

dynamically awarding, by the at least one server, the plurality of non-winning prizes to the at least one pool of non-winning players; and dynamically causing to display, by the at least one server, via a specifically programmed graphical user interface, a notification about each of the plurality of non-winning prizes to each non-winning player of the pool of non-winning players.

17. The game-operating computer method of claim 16, wherein the game drawing is a lottery.

18. The game-operating computer method of claim 17, wherein each of non-winning player is a player who picked between 1 and 5 of 6 winning numbers.

19. The game-operating computer method of claim 17, wherein each of non-winning player is a player who picked between 1 and 4 of 5 winning numbers.

20. The game-operating computer method of claim 16, wherein the draw sales are at least partially funded from at least one previous game drawing.

* * * * *